United States Patent [19]

Gauron et al.

[11] 4,113,292

[45] Sep. 12, 1978

[54] LATCH

[75] Inventors: Richard F. Gauron, Issaquah; Susana S. Laconte, Auburn, both of Wash.

[73] Assignee: Marketing Masters, Issaquah, Wash.

[21] Appl. No.: 814,330

[22] Filed: Jul. 11, 1977

[51] Int. Cl.[2] ..... E05C 1/16

[52] U.S. Cl. ..... 292/165; 292/174; 292/336.3; 292/DIG. 30

[58] Field of Search ..... 292/165, 166, 35, 168, 292/174, 221, 336.3, DIG. 30, DIG. 31, DIG. 63

[56] References Cited

U.S. PATENT DOCUMENTS

| | | | |
|---|---|---|---|
| 475,368 | 5/1892 | Welch | 292/174 X |
| 1,026,747 | 5/1912 | Jansen | 292/166 |
| 2,476,520 | 7/1949 | Waitekaites | 292/165 X |
| 3,357,733 | 12/1967 | Heifetz | 292/165 |
| 3,402,422 | 9/1968 | Baer | 16/163 |
| 3,494,650 | 2/1970 | Slopa | 292/166 X |
| 3,552,158 | 1/1971 | Van Lengen | 292/166 X |
| 3,909,051 | 9/1975 | Nakai | 292/166 |

*Primary Examiner*—Roy D. Frazier
*Assistant Examiner*—William E. Lyddane
*Attorney, Agent, or Firm*—Nicolaas Devogel

[57] ABSTRACT

The latching apparatus has an external housing which contains a recess, an internal activating mechanism and a biased locking bolt for engagement with an associated striker plate. The operation of the latch is accomplished by inserting the hand into the recess and sliding a therein positioned handle cup. The movement of the cup causes, inside of the activating mechanism, the spreading of two levers which are geared to one another and are connected to the spring biased locking bolt. The levers will upon movement make contact with a pivot point and the resulted leverage action will pull the bolt to a retracted or unlatched position. Release of the handle cup automatically reverses the operation and moves the bolt in the latching position.

2 Claims, 6 Drawing Figures

FIG. 1
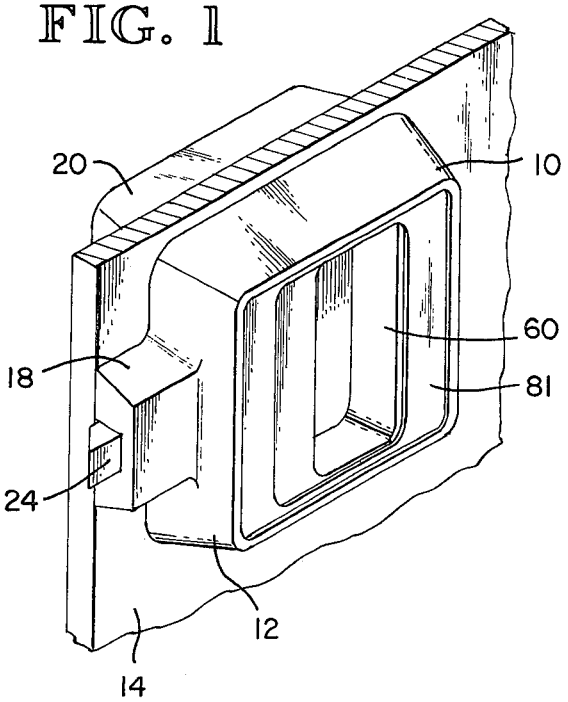
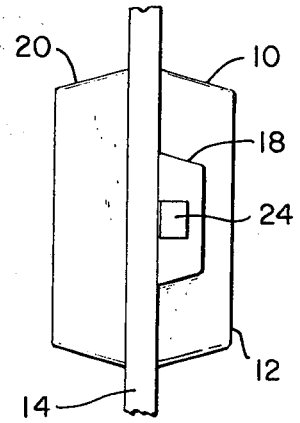
FIG. 2
FIG. 3
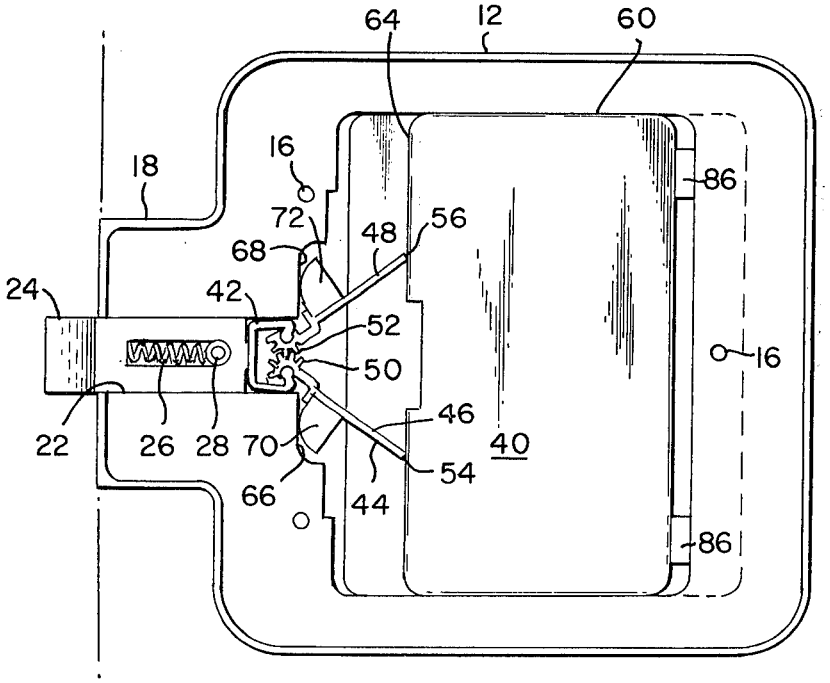

LATCH

BACKGROUND OF THE INVENTION

This invention relates to a latching apparatus of the type in which an extended bolt is selectively retracted by manually pressing a recessed door handle or cup. The prior art provides for many latching mechanisms, one of which appear close to the present invention. A thorough search revealed the following U.S. patents which seem simple in construction, using few components, however which do not achieve the objectives as obtained by the present invention.

Preference be given to U.S. Pat. Nos. 959,081, 972,769, 3,201,161 and 3,552,158, all requiring internal door mounting and operating on different principles.

External mounted latches being considered as reference U.S. Pat. Nos. were found to be 1,828,152 and 3,357,734.

Finally, the most pertinent art found appeared to be recent and was issued in U.S. Pat. No. 3,909,051. Here, however, the mechanism required in-door mounting and is rather complicated using more parts and is limited to door thickness. The operation of the latch by Mr. Nakai seems similar inside the hand recessed opening, and the activating procedures for unlatching are identical, however the mechanism is different and complicated.

In summary, the present invention provides for a latching mechanism that can be attached to any door regardless of thickness, can be mounted and detached in seconds, operates quietly and easily, needs no maintenance, can be economically manufactured, does not show any mounting means, is not abnormally protruding, has a mechanism which is most simple and reliable, having few moving parts, besides offering a flush, thin, modern and attractive appearance.

SUMMARY OF THE INVENTION

A door latch according to the present invention includes a A extended bolt and an actuating mechanism for retracting the bolt so that an unlatched or door opening condition can be obtained. By closing the door, the bolt will automatically retract against the striker plate mounted at the door joint and latch the door as is well known in the art. In the present invention, it is the simplicity of the operation of the mechanism and the very few components involved which make the arrangement unique and economic.

Basically, the movement of a pair of levers in synchronized turning, and substantially simultaneously pivoting, is achieved in accurate fashion. A reliable latching for one way or two way opening of closing means is achieved. Accordingly, it is an object of the present invention to provide for a simple latching apparatus which can be mounted to any closing means regardless of thickness for achieving one way or two way unlatching and automatically latching the closing means.

It is a further object to provide a knobless flat latching apparatus which can be easily attached, mounted or removed. It is another object of the present latching apparatus to provide for a simple latching mechanism having a minimum of components and providing a high reliability in operation.

Other features, objects and advantages of the present invention will become apparent from the detailed description to follow in conjunction with the accompanying drawings.

BRIEF DESCRIPTION OF THE DRAWINGS

FIG. 1 is a perspective of the latching apparatus mounted on both sides of the door or the like.

FIG. 2 is a view at the door jam.

FIG. 3 is an internal arrangement of the mechanism of the latching apparatus in normal locked position looking from the door surface outwards.

DETAILED DESCRIPTION OF THE PREFERRED EMBODIMENT

Figure 4:
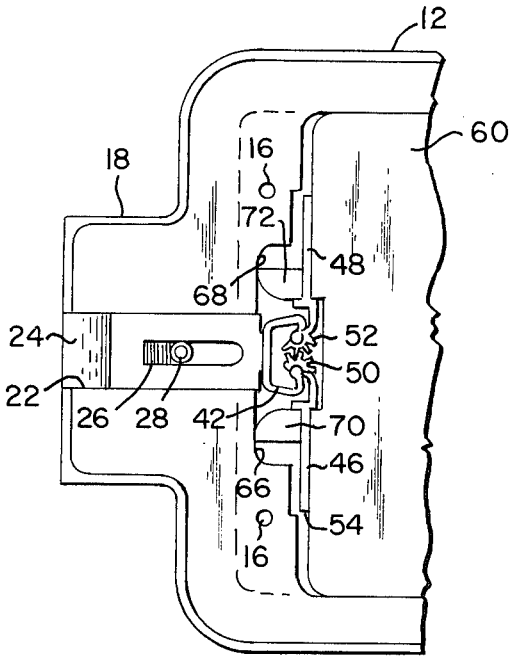
FIG. 4 is an internal arrangement of the mechanism of the latching apparatus in activated or open position.

In FIGS. 1–3 there is illustrated a door latching apparatus 10 and also a follower latching apparatus 20 which are used on doors which are to be opened from each direction. Of course, in the event that the latching apparatus 10 is used on a closet door or drawer, the follower latching apparatus 20 is not needed. The housing 12 is externally mounted on a door 14 by fastening means, glue, screws 16, or the like.

In FIG. 3 the housing 12 has somewhat rectangular shape with an additional bolt chamber portion 18 containing a slot 22 for guiding a bolt or locking bar 24. A spring 26, which is anchored to a pin 28, mounted to the housing 12, biases the bolt 24 to a latching or a protruding (from the housing) position.

Figure 5:
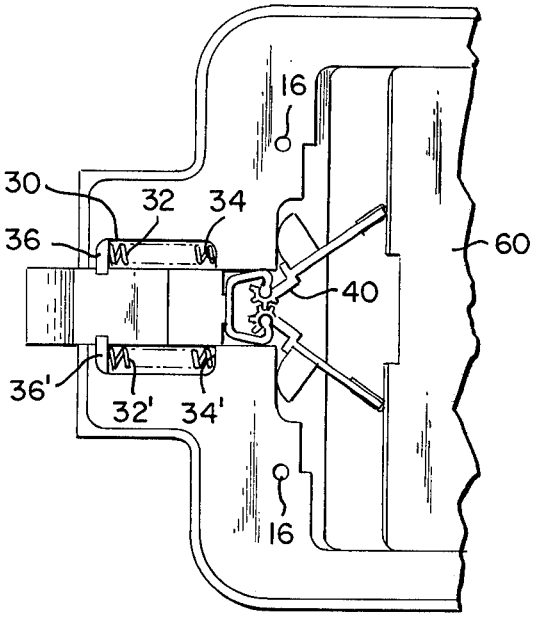
FIG. 5 is a second embodiment of the present invention similar to the showing of FIG. 3.

In FIG. 5, a different spring arrangement 30 having springs 32 and 32' is illustrated wherein the springs 32 and 32' are expanding and a continuous force between the interior housing surfaces 34 and 34' and the bolt flanges 36 and 36' is exerted so that again, as in FIG. 3, the bolt is in a latching biased position.

Mounted on the bolt 24 is a ROTAN ® hinge assembly 40, trademarked in the United States by the ROTAN CORPORATION. This hinge assembly 40 comprises a channel 42 having a "U" shaped cross sectional configuration and lever means 44 or first levers 46 and second lever 48 hingeably connected to the "U" channel 42 in geared relationship with one another since each lever 46 and 48 is provided with integrally hinging gears at their first end portion 50 and 52, respectively. The levers 46 and 48 are at a predetermined angular position located in the housing and in contact with their second end portions 54 and 56 to the surface 58 of a handle cup means 60. The handle cup means 60 is slideably positioned within the housng 12 and has a somewhat box or drawer shape configuration with the open side of the cup in alignment with a hand insertable recess opening 62 provided in the housing. Thus, when a person inserts part of the hand or fingers in the opening 62, the cup 60 can be moved toward the lever assembly 40. The levers 46 and 48, when turned about their first end 50–52, will also pivot somewhere at a portion between the first ends 50–52 and second ends 54–56 by coming in contact with a shoulder portion 66–68 in the interior of the housing. In the preferred configuration, this pivoting or pivot means is emphasized by the addition of a cam portion 70 and 72 provided on the levers 46 and 48, respectively. Accordingly, when the cup 60 is slid by the pressure of a hand towards the hinge assembly 40, the levers 46 and 48 will slide at their second end portion along the cup surface 64 and cause turning about their geared, hingeable connection at 50 and 52. The surfaces 66–68 will become in contact with the cams 70 and 72, and the bolt 24 will be pulled inside of the housing 12. Release of the hand from the cup 60 will provide the return of the bolt 24 in its latched position due to the spring 26 or springs 32–32' forces.

It should be understood that the lever mechanism 40 has the feature of two levers turning in synchronized unison by meshing relationship with their first rotationally mounted gear portions, and that this arrangement provides for an equal parting of the manually applied force over the two levers to easily retract the bolt 24. But it should also be understood that one lever would be able to accomplish the same operation, and accordingly the necessary operational means in the present invention can be stated as lever means for accomplishing the operation of the lever mechanism 40.

Figure 6:
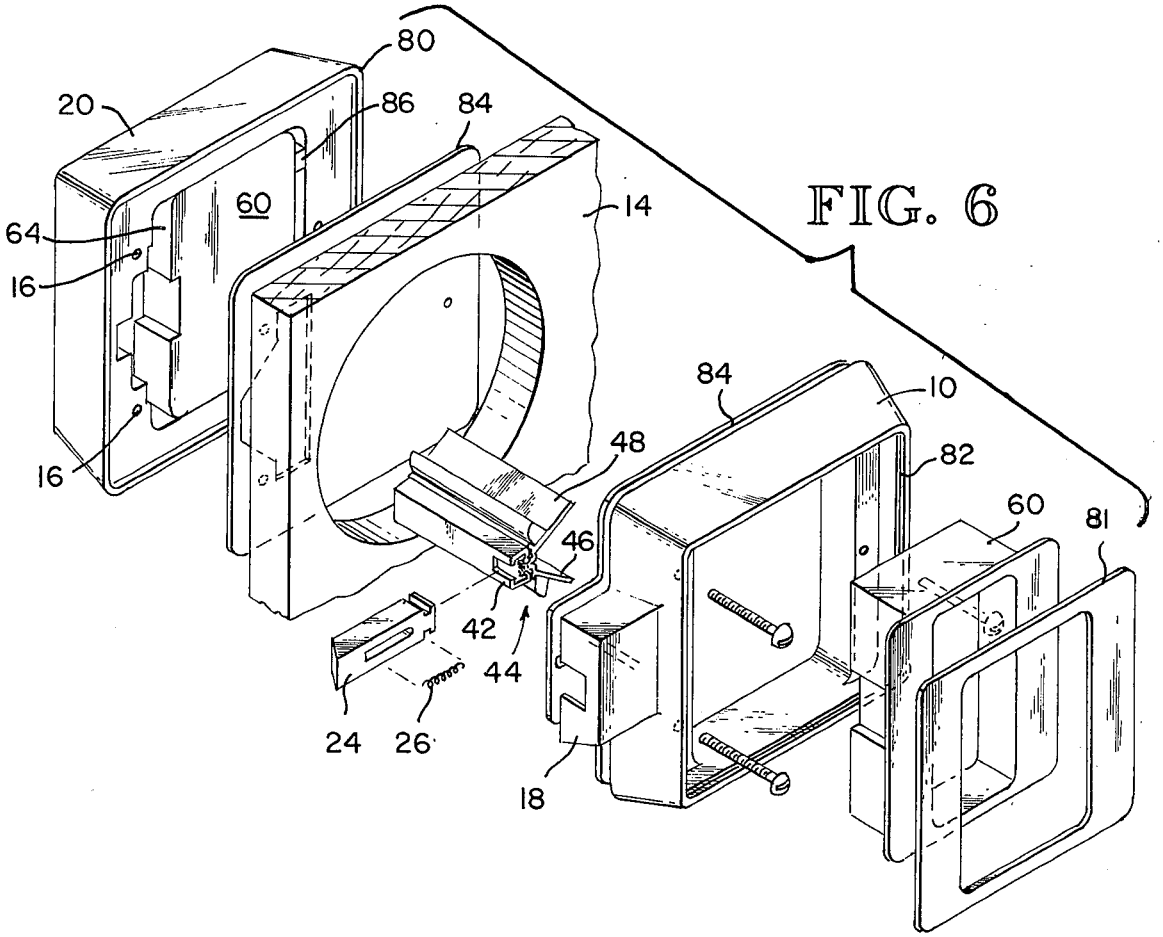
FIG. 6 is an exploded view of the latching apparatus and a follower latching apparatus on each side of a door.

As mentioned before, the latch assembly 10 is mounted on the side of a door and can be fastened by glue, screws or the like and the thickness of the door 14 is of no concern. Holes through the door are not needed unless screws are used or unless one desires to be able to open the door from each direction. Because utilization of the present latch is expected in two way opening applications, the illustrations are complete for such use, and accordingly, a follower latching apparatus 20 is shown in FIG. 6. The follower latching apparatus 20 has a housing 80 which has no provisions for a bolt 24, and accordingly, the chamber portion 18 as in housing 12 is omitted.

Furthermore, the housing 80 is to be mounted opposite in mirror image fashion to the door 14 opposite housing 12, and in this event a hole has to be provided through the door for the extension of the hinge assembly 40, being just wider so that the follower latching apparatus cup 60' can be in contacting arrangement. The second cup 60' is similarly arranged in the housing 80 for the sliding or unlatching operation as explained for housing 12. In the present illustrated preferred embodiments, there are additional components which are not essential to the mounting operation of the latching apparatus, but do improve the performance.

For instance, the cup 60 is retained in the housing 12 or 80 by an attractive looking, flexible face plate 81 which is inserted in grooves 82 provided in the housing 12 or 80 at the edge of the recess opening 62. In addition, the mechanism is retained by a plastic inner face plate 84 which preferably is recessed within the housing material so that the housing 12 or 80 are flat against the door 14.

Teflon coating may be provided at the surface 64, 66 and 68, as well as at the end portions 54 and 56. To keep a noiseless and soft sliding operation, cushion means 86 may be installed between cup 60 and interior wall locations, as illustrated.

Also in FIG. 4, the unlatched position shows a complete folded-up condition of the levers 46 and 48. This position, however, is not essential or critical as long as the bolt 24 is retracted. In other words, the present invention teaches the most preferred arrangement. For instance, the bolt 24 is connected to the channel 42 by insertion in FIG. 6 rather than being permanently mounted which would suffice the purpose likewise.

Altogether it can be be seen that many variations are possible which are thoroughly familiar to anyone skilled in the art. Therefore, it is to be understood that the foregoing description is illustrative only of preferred embodiments, and not limiting, and that the true spirit and scope of this present invention will be determined by reference to the appended claims.

Now therefore, we claim:

1. A latching apparatus comprising in combination:

a. a housing provided with mounting means and a hand insertable recess;

b. an associated striker plate;

c. a bolt slideably positioned inside of said housing and partly protruding therefrom for latching engagement with said associated striker plate;

d. a spring means mounted between said bolt and said housing for biasing said bolt in a position causing part of said bolt to protrude out of said housing for latching;

e. a handle cup means slideably positioned inside of said housing in alignment with said recess opening and adapted to receive part of one's hand;

f. a lever means including:

1. a first and a second lever each having a first geared end and a second end, each said first and second lever positioned between said bolt and said handle cup means at a predetermined angle with said second end of each said first and said second lever in slidable contact with said handle cup means;

2. a "U" shaped channel member mounted by its base to said bolt;

3. a hingeable connection formed between said "U" shaped channel member and said first geared end of each said first and second lever, respectively, whereby said first geared end of said first lever intermeshes with said first geared end of said second lever for synchronized movement of said first and said second lever;

g. shoulder means in said housing for engagement with said first and said second lever, at a location between said first geared end and said second end of each said first and said second lever whereby, upon manual sliding of said handle cup means, each said second end of said first and said second lever slides along said cup means thereby turning said first and said second lever about said hingeable connection in synchronized movement until said first and said second lever engages with said shoulder means so that said first and said second lever pivot about said shoulder means thereby pulling via said hingeable connection said slideably positioned bolt inside of said housing for unlatching said bolt from said associated striker plate, and whereby upon manual release of said handle cup means, said spring means slides said bolt in a latching position and repositions said lever means and said handle cup means.

2. A latching apparatus for a two way door or the like, comprising in combination:

a. a housing provided with mounting means and a hand insertable recess, said housing to be mounted on one side of said door;

b. an associated striker plate;

c. a bolt slideably positioned inside of said housing and partly protruding therefrom for latching engagement with said associated striker plate;

d. a spring means mounted between said bolt and said housing for biasing said bolt in a position wherein part of said bolt protrudes out of said housing for latching;

e. a handle cup means slideably positioned inside of said housing in alignment with said recess opening and adapted to receive part of one's hand;

f. a lever means including:

1. a first and a second lever each having a first geared end and a second end, each said first and second lever positioned between said bolt and said handle cup means at a predetermined angle with said second end of each said first and said second lever in slideable contact with said handle cup means;
2. a "U" shaped channel member mounted by its base to said bolt;
3. a hingeable connection formed between said "U" shaped channel member and said first geared end of each said first and said second lever, respectively, whereby said first geared end of said first lever intermeshes with said geared end of said second lever for synchronized movement of said first and said second lever;

g. shoulder means located in said housing for engagement with said lever means at a lever portion between said first and second end;

h. a follower latching apparatus having a follower housing with a slideable follower handle cup similar to said housing and said cup for mounting opposite to said one side of door; and i. said lever means disposed on slideable contact with said follower handle cup, whereby upon manually sliding movement of said cup or said follower cup, said lever means turns about said hingeable connection and said lever portion contacts said shoulder means so that said lever means pivots about said shoulder means and pulls via said hingeable connection said bolt in slideable movement inside of said housing, unlatching said bolt from said associated striker plate, and whereby upon manual release of said cup or said follower cup, said spring means will slide said bolt in a latching position and reposition said lever means and said handle cup or said follower cup means.

* * * * *